US010061235B2

(12) United States Patent
Shoji et al.

(10) Patent No.: US 10,061,235 B2
(45) Date of Patent: Aug. 28, 2018

(54) FIXING DEVICE AND IMAGE FORMING APPARATUS

(71) Applicants: Keitaro Shoji, Kanagawa (JP); Yasunori Ishigaya, Kanagawa (JP); Kazuya Saito, Kanagawa (JP); Ryohei Matsuda, Kanagawa (JP); Hiromasa Takagi, Tokyo (JP); Ryuuichi Mimbu, Kanagawa (JP); Toshihiko Shimokawa, Kanagawa (JP)

(72) Inventors: Keitaro Shoji, Kanagawa (JP); Yasunori Ishigaya, Kanagawa (JP); Kazuya Saito, Kanagawa (JP); Ryohei Matsuda, Kanagawa (JP); Hiromasa Takagi, Tokyo (JP); Ryuuichi Mimbu, Kanagawa (JP); Toshihiko Shimokawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 29 days.

(21) Appl. No.: 15/395,410

(22) Filed: Dec. 30, 2016

(65) Prior Publication Data

US 2017/0205742 A1 Jul. 20, 2017

(30) Foreign Application Priority Data

Jan. 14, 2016 (JP) ..... 2016-005537

(51) Int. Cl.
*G03G 15/20* (2006.01)

(52) U.S. Cl.
CPC ..... *G03G 15/2039* (2013.01)

(58) Field of Classification Search
CPC ..... G03G 15/2053; G03G 15/2039; G03G 15/2042; G03G 2215/2035
(Continued)

(56) References Cited

U.S. PATENT DOCUMENTS

2011/0222929 A1 9/2011 Fujimoto et al.
2013/0170879 A1 7/2013 Yoshinaga et al.
(Continued)

FOREIGN PATENT DOCUMENTS

JP 2010-107557 5/2010
JP 2012-189770 10/2012
(Continued)

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

A fixing device includes an endless fixing belt that is multilayered, an opposing rotator disposed opposite the fixing belt and pressed to the fixing belt to form a nip, a heater disposed inside the fixing belt, and a safety device including a contactless temperature sensor disposed outside the fixing belt and apart from an outer face of the fixing. The fixing belt is to rotate and thermally expand. The contactless temperature sensor detects a temperature of the fixing belt. The safety device stops heating by the heater when the temperature detected by the contactless temperature sensor is at or higher than a predetermined temperature. As the outer face of the fixing belt shifts outward in the radial direction due to thermal, a proportion of the outer face of the fixing belt in a viewing angle of the contactless temperature sensor increases.

9 Claims, 5 Drawing Sheets

(58) Field of Classification Search
USPC ..... 399/33
See application file for complete search history.

(56) References Cited

U.S. PATENT DOCUMENTS

| | | | | |
|---|---|---|---|---|
| 2013/0209125 | A1 | 8/2013 | Uchitani et al. | |
| 2014/0270833 | A1* | 9/2014 | Yuasa ..... | G03G 15/2017 399/67 |
| 2015/0261151 | A1 | 9/2015 | Ishigaya et al. | |
| 2015/0261161 | A1 | 9/2015 | Waida et al. | |
| 2016/0116869 | A1 | 4/2016 | Saito et al. | |
| 2016/0124359 | A1 | 5/2016 | Ikebuchi et al. | |

FOREIGN PATENT DOCUMENTS

| | | |
|---|---|---|
| JP | 2013-137470 | 7/2013 |
| JP | 2013-164438 | 8/2013 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2016-005537, filed on Jan. 14, 2016, in the Japan Patent Office, the entire disclosure of which is hereby incorporated by reference herein.

BACKGROUND

Technical Field

Embodiments of the present disclosure relate to a fixing device to fix a toner image on a recording medium, and an image forming apparatus including the fixing device.

Description of the Related Art

Currently, regarding image forming apparatuses such as printers, copiers, and facsimile machines, demands for speedup and extended operational life are increasing.

In image forming apparatuses, unfixed toner images are formed, either directly or via a transfer medium, on recording media through image forming process employing electrophotography, electrostatic recording, magnetic recording, or the like. The recording media include recording sheets, printing paper, photosensitive sheets, and electrostatic recording sheets. There are various types of fixing devices to fix unfixed toner images. Widely used fixing device type is contact-heating type, such as roller heating, film heating, and electromagnetic induction heating.

There are fixing devices in which an endless fixing belt having a low thermal capacity is directly heated without using a heat conductor made of metal, to cope with speed up of image forming apparatuses. In such fixing devices, in heating the fixing belt, the speed of temperature rise thereof is faster. Accordingly, there is a risk that, due to control failure of some kind, the temperature of the fixing belt rises abruptly and exceeds a predetermined temperature (e.g., a highest tolerable temperature). Therefore, fixing devices are generally provided with a safeguard to stop heating in the case of such an abrupt temperature rise.

SUMMARY

An embodiment of the present invention provides a fixing device that includes a fixing belt having an endless shape and including at least two layers adjacent in a radial direction of the fixing belt, an opposing rotator disposed opposite the fixing belt and pressed to the fixing belt to form a nip, a heater disposed inside the fixing belt to heat the fixing belt, and a safety device including a contactless temperature sensor disposed outside the fixing belt and apart from an outer face of the fixing belt. The fixing belt is to rotate and thermally expand. The contactless temperature sensor is to detect a temperature of the fixing belt, and the safety device stops heating by the heater when the temperature detected by the contactless temperature sensor is equal to or higher than a predetermined temperature. The contactless temperature sensor is disposed such that a proportion of the outer face of the fixing belt in a viewing angle of the contactless temperature sensor increases as the outer face of the fixing belt shifts outward in the radial direction due to thermal expansion of the fixing belt.

In another embodiment, an image forming apparatus includes an image forming device to form an image, and the above-described fixing device to fix the image.

In yet another embodiment, a fixing device includes the fixing belt, the opposing rotator, the hater, and the contactless temperature sensor described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
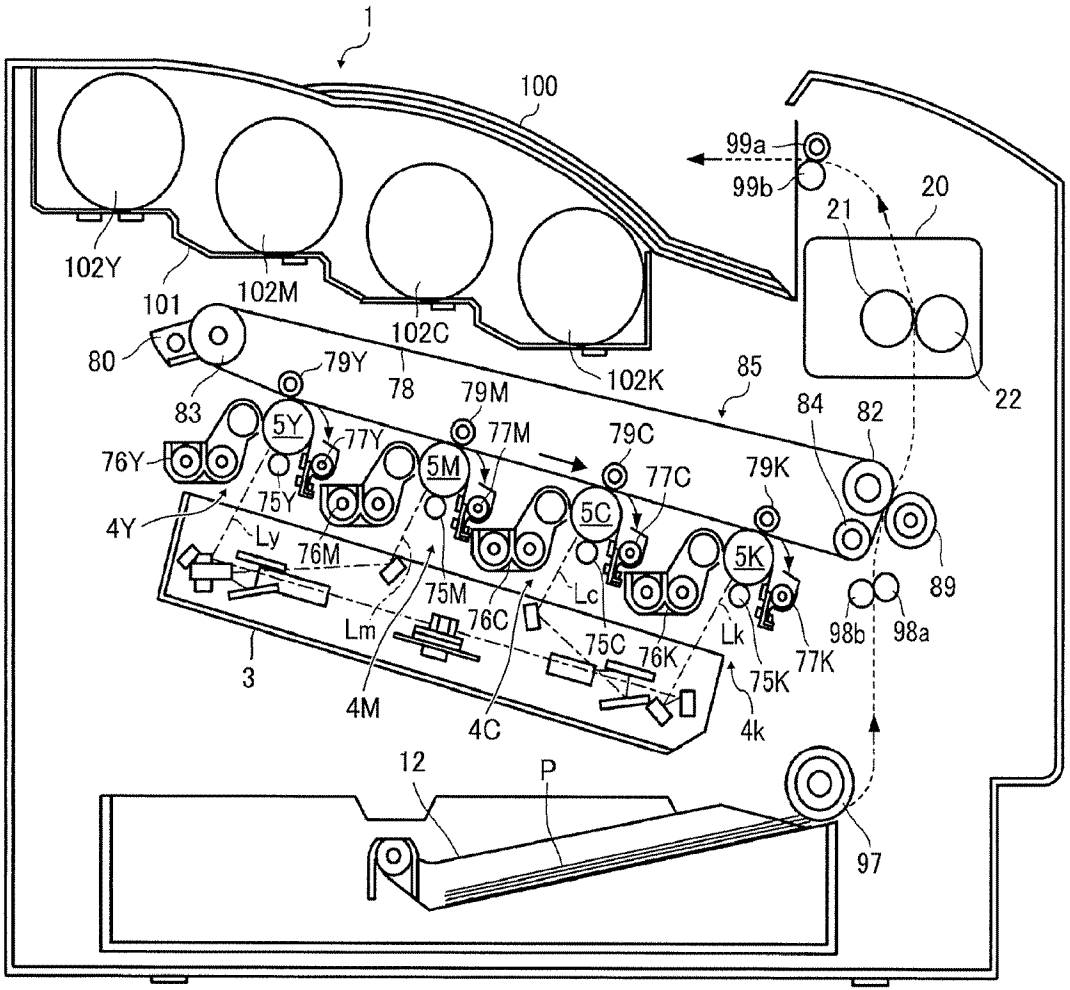
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of the present invention is described. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

[Image Forming Apparatus]

FIG. 1 illustrates an image forming apparatus 1, which is a color printer employing a tandem system, for example. The image forming apparatus 1 includes a bottle mount 101 disposed in an upper part of the body thereof (i.e., an apparatus body). Toner bottles 102Y, 102M, 102C, and 102K respectively containing yellow, magenta, cyan, and black toners, are removably mounted in the bottle mount 101.

An intermediate transfer unit 85 is disposed below the bottle mount 101. The intermediate transfer unit 85 includes an intermediate transfer belt 78, four primary-transfer bias rollers 79Y, 79M, 79C, and 79K, a secondary-transfer backup roller 82, a cleaning backup roller 83, a tension roller 84, and a belt cleaner 80. The image forming apparatus 1 further includes image forming units 4Y, 4M, 4C, and 4K (collectively "image forming units 4") respectively corresponding to yellow, magenta, cyan, and black, disposed facing the intermediate transfer belt 78.

The image forming units 4Y, 4M, 4C, and 4K include photoconductor drums 5Y, 5M, 5C, and 5K (collectively "photoconductor drums 5"), respectively. Around the photoconductor drum 5, a charger 75 (75Y, 75M, 75C, or 75K), a developing device 76 (76Y, 76M, 76C, or 76K), a cleaning device 77 (77Y, 77M, 77C, or 77K), and a discharger are disposed.

The photoconductor drum 5 is cylindrical and rotated by a driving source. The photoconductor drum 5 includes a photosensitive layer. When an exposure device 3 irradiates the surface of the photoconductor drum 5 with light beam L (Ly, Lm, Lc, or Lk) indicated by broken lines in FIG. 1, an electrostatic latent image according to image data is formed on the surface of the photoconductor drum 5. The image data is either scanned by a scanner or obtained from a terminal via a network.

In the present embodiment, the charger 75 is a contact type charger to uniformly charge the surface of the photoconductor drum 5 while being in contact with the photoconductor drum 5.

The developing device 76 supplies toner to the photoconductor drum 5. The supplied toner adheres to the electrostatic latent image written on the surface of the photoconductor drum 5, thereby developing the latent image into a toner image. In the present embodiment, the developing device 76 causes the toner to adhere to the electrostatic latent image without contacting the photoconductor drum 5 (i.e., contactless type).

The cleaning device 77 removes residual toner remaining on the surface of the photoconductor drum 5. In the present embodiment, the cleaning device 77 includes a brush that contacts the surface of the photoconductor drum 5 (i.e., contact brush type).

The intermediate transfer belt 78 is entrained around the secondary-transfer backup roller 82, the cleaning backup roller 83, and the tension roller 84 and is rotated in the direction indicated by an arrow illustrated in FIG. 1 as the secondary-transfer backup roller 82 rotates.

The intermediate transfer belt 78 is an endless belt, a base of which is resin film or rubber. The toner images formed on the photoconductor drums 5Y, 5M, 5C, and 5K are transferred onto the intermediate transfer belt 78. The toner image is transferred from the intermediate transfer belt 78 onto the recording sheet P.

The image forming units 4Y, 4M, 4C, and 4K form single-color images on the respective photoconductor drums 5Y, 5M, 5C, and 5K through a sequence of image forming process including charging, exposure, developing, transfer, and cleaning.

The primary-transfer bias rollers 79Y, 79M, 79C, and 79K nip the intermediate transfer belt 78 together with the photoconductor drums 5Y, 5M, 5C, and 5K, and portions where the primary-transfer bias rollers 79Y, 79M, 79C, and 79K contact the intermediate transfer belt 78 are called "primary transfer nips". Each primary-transfer bias roller 79 is coupled to a power supply and receives a transfer bias opposite in polarity from the toner.

The secondary-transfer backup roller 82 nips the intermediate transfer belt 78 together with a secondary transfer roller 89. The nipped portion is called "secondary transfer nip". Similar to the primary-transfer bias rollers 79, the secondary-transfer backup roller 82 is coupled to a power supply, and a predetermined transfer bias including at least one of direct current (DC) voltage and alternating current (AC) voltage is applied to the secondary-transfer backup roller 82. The intermediate transfer unit 85 and the secondary transfer roller 89 together serve as a transfer device to transfer the image formed by the image forming unit 4 onto the recording medium.

The exposure device 3 to expose the surface of the photoconductor drums 5 is disposed below the image forming units 4. The exposure device 3 includes a light source, a polygon mirror, an f-θ lens, and reflection mirrors, and is configured to irradiate, with the laser beams, the surfaces of the photoconductor drums 5 according to the image data.

In a lower section of the image forming apparatus 1, a sheet tray 12 containing the recording sheets P and a sheet feeding roller 97 to feed the recording sheets P from the sheet tray 12 are disposed. The recording sheets P include, in addition to plain paper, heavy paper, post cards, envelopes, thin paper, coated paper, art paper, tracing paper, overhead projector (OHP) films, and special purpose sheets. The image forming apparatus 1 can further include a bypass sheet feeder or a manual sheet feeder (e.g., inserter).

Next, image forming process is described below.

Initially, in the charging process, the photoconductor drums 5 are rotated clockwise in FIG. 1 by a driving motor. The surfaces of the photoconductor drums 5 are charged uniformly by the chargers 75, respectively, at the positions facing the chargers 75.

Subsequently, in the exposure process, the surfaces of the photoconductor drums 5 reach the positions to receive the laser beams Ly, Lm, Lc, and Lk emitted from the exposure device 3 and scanned with the laser beams Ly, Lm, Lc, and Lk to form the electrostatic latent images corresponding to one of yellow, magenta, cyan, and black.

Then, the surfaces of the photoconductor drums 5 reach the positions facing the developing devices 76, where the latent images are developed into toner images.

When the surface of the photoconductor drums 5 carrying the toner images reach the positions facing the primary-transfer bias rollers 79 via the intermediate transfer belt 78, the toner images are transferred onto the intermediate transfer belt 78 (primary transfer process). After the primary transfer process, a certain amount of toner tends to remain on the photoconductor drums 5.

Subsequently, the surfaces of the photoconductor drums 5 reach the positions facing the cleaning devices 77, where cleaning blades of the cleaning devices 77 mechanically collect the toner remaining on the photoconductor drums 5 (the cleaning process).

Subsequently, the surfaces of the photoconductor drums 5 reach the positions facing the dischargers, where the dischargers remove residual potentials remaining on the surfaces of the photoconductor drums 5. Thus, a sequence of image forming process performed on the photoconductor drums 5 is completed.

Then, the respective toner images are transferred from the photoconductor drums 5 and superimposed one on another on the intermediate transfer belt 78. Thus, a multicolor toner image is formed on the intermediate transfer belt 78.

Next, transfer process is described below.

While rotating in the direction indicated by the arrow illustrated in FIG. 1, the intermediate transfer belt 78 sequentially passes through the primary transfer nips between the photoconductor drums 5 and the corresponding primary-transfer bias rollers 79. Then, the single-color toner images on the photoconductor drums 5 are primarily transferred and superimposed one on another on the intermediate transfer belt 78.

The intermediate transfer belt 78 carrying the multicolor toner image reaches a position facing the secondary transfer roller 89. The secondary-transfer backup roller 82 nips the intermediate transfer belt 78 with the secondary transfer roller 89, forming the secondary transfer nip. The multicolor toner image on the intermediate transfer belt 78 is transferred onto the recording sheet P transported to the secondary transfer nip (a secondary transfer process). A certain amount of toner tends to remain untransferred on the intermediate transfer belt 78 after the secondary transfer process.

When the intermediate transfer belt 78 reaches a position facing the belt cleaner 80, the toner remaining on the intermediate transfer belt 78 is collected by the belt cleaner 80. Thus, the transfer process on the intermediate transfer belt 78 is completed.

Next, image forming operation is described below.

The recording sheet P is transported from the sheet tray 12, which is disposed in the lower section of the image forming apparatus 1, to the secondary transfer nip via the sheet feeding roller 97, a pair of registration rollers 98*a* and 98*b*, and the like. The sheet tray 12 contains multiple recording sheets P piled one on another. As the sheet feeding roller 97 rotates counterclockwise in FIG. 1, the top sheet of the recording sheets P in the sheet tray 12 is fed toward a nip between the registration rollers 98*a* and 98*b*.

The recording sheet P is stopped in the nip between the registration rollers 98*a* and 98*b*, which have stopped rotating. The registration rollers 98*a* and 98*b* forward the recording sheet P to the secondary transfer nip, timed to coincide with the multicolor toner image on the intermediate transfer belt 78. Thus, the multicolor toner image is transferred onto the recording sheet P.

Subsequently, the recording sheet P carrying the multicolor image is transported to a fixing device 20. In the fixing device 20, a fixing belt 21 and a pressure roller 22 apply heat and pressure to the recording sheet P to fix the multicolor toner image on the recording sheet P.

Subsequently, the recording sheet P is discharged via a pair of ejection rollers 99*a* and 99*b* outside the apparatus. The recording sheets P discharged are sequentially stacked as output images on a stack section 100. Thus, the image forming process is completed.

Although the description above relates to full-color image formation on the recording sheet P, alternatively, single color, bicolor, and three-color images can be formed using one, two, or three of the four image forming units 4.

Figure 8:
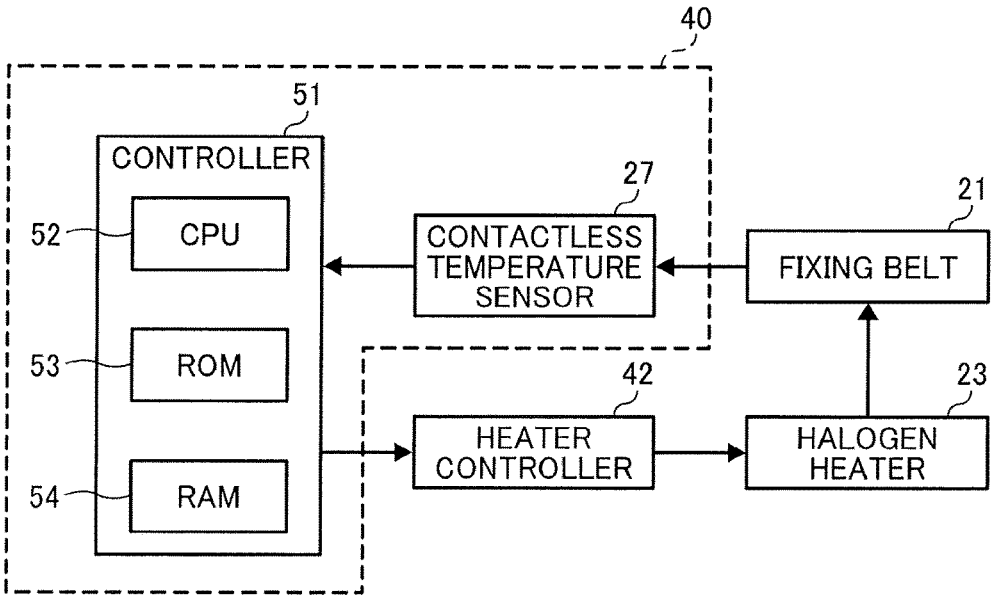
FIG. 8 is a block diagram of a safety device according to an embodiment.

As illustrated in FIG. 8, the image forming apparatus 1 includes a controller 51 (i.e., an apparatus-side controller) and a control panel (i.e., an operation input device). The controller 51 includes a microcomputer including a central processing unit (CPU) 52, a read only memory (ROM) 53, a random access memory (RAM) 54, an input/output (I/O) interface, and the like. The CPU 52 executes programs stored in the ROM 53 for control operation.

The controller 51 is connected to the control panel as well as various sensors and motors of the image forming apparatus 1. The controller 51 is configured to control motors, such as the driving motor to drive the photoconductor drums 5 and drivers to drive the pressure roller 22 based on detection signals input from the sensors. The controller 51 is further configured to control passage of electricity to a halogen heater 23 via a heater controller 42.

The control panel is disposed in the body of the image forming apparatus 1 and includes numeric keys, various keys such as a print start key, and various indicators. The control panel is configured to output, to the controller 51, signals input via the various keys.

In an embodiment, the image forming apparatus 1 further includes a facsimile tray. In such a configuration, when the controller 51 receives facsimile signals representing image data via the telephone line, the recording sheet on which an image is fixed by the fixing device 20 is transported to the facsimile tray.

(Fixing Device)

Next, descriptions are given below of the structure of the fixing device 20, with reference to FIG. 2.

Figure 2:
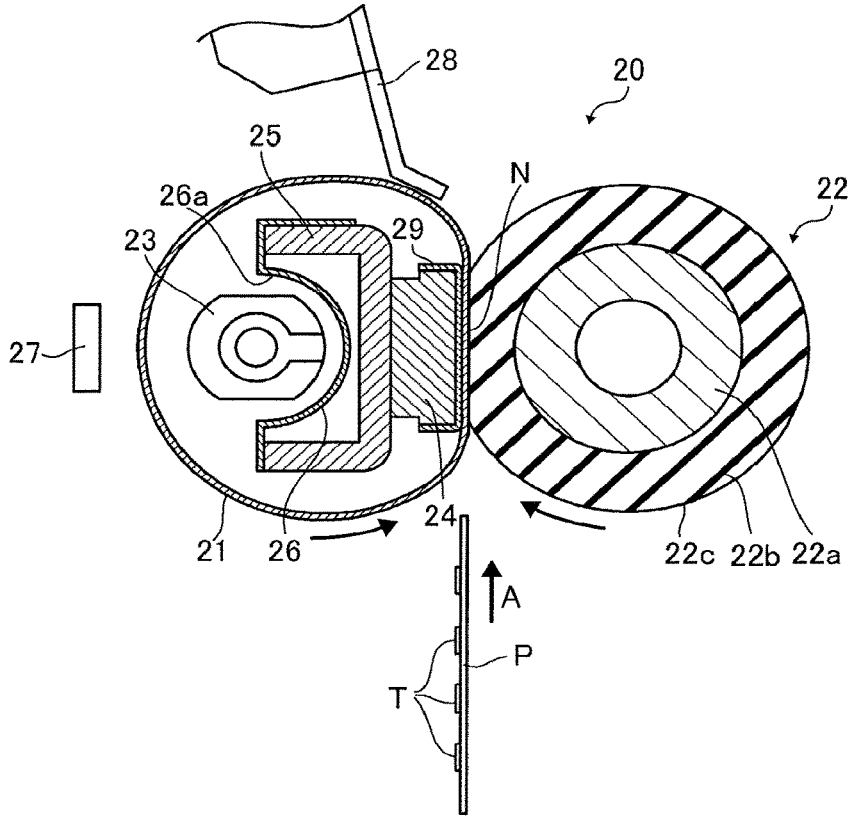
FIG. 2 is a schematic view of a fixing device according to an embodiment.

As illustrated in FIG. 2, the fixing device 20 includes the fixing belt 21 serving as a fixing rotator to rotate, the pressure roller 22 serving as an opposing rotator and rotatably disposed opposite the fixing belt 21, and the halogen heater 23 serving as a heater to heat the fixing belt 21. In the example illustrated in FIG. 2, the fixing device 20 employs one halogen heater 23. Inside the loop of the fixing belt 21, the fixing device 20 further includes a nip forming pad 24 (i.e., a nip forming member), a stay 25 to support the nip forming pad 24, and a reflector 26 to reflect light emitted from the halogen heater 23 to the fixing belt 21. The fixing device 20 further includes a contactless temperature sensor 27 to detect the temperature of the fixing belt 21, a separator 28 to separate the recording sheet P from the fixing belt 21, and a pressing member to press the pressure roller 22 to the fixing belt 21.

Figure 6:
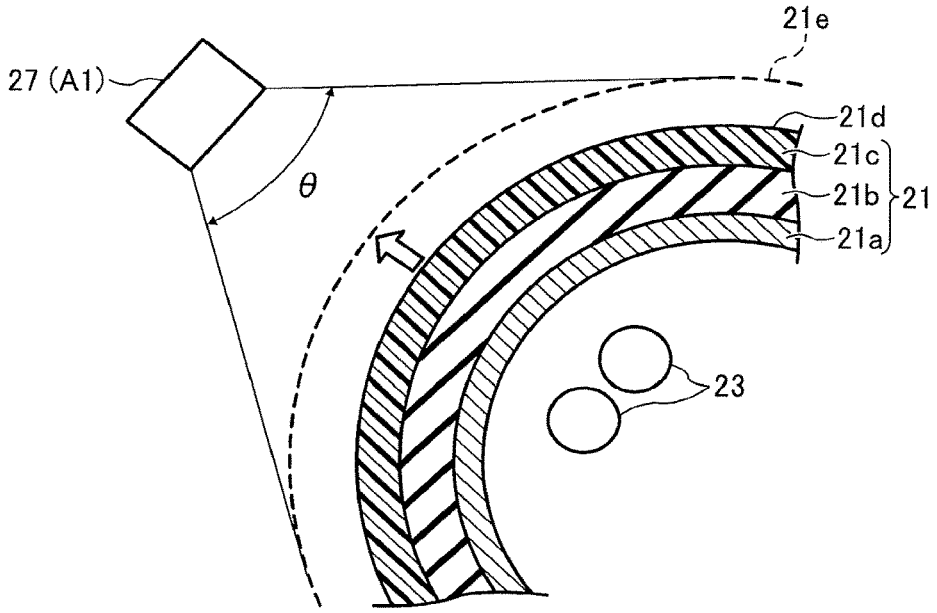
FIG. 6 is a cross-sectional view illustrating relative positions of the contactless temperature sensor and a multilayered fixing belt according to an embodiment.

The fixing belt 21 is a thin, flexible belt having an endless shape. An endless film can be used instead. Specifically, as illustrated in FIG. 6, the fixing belt 21 includes a base layer 21*a*, located on the inner side in the radial direction of the looped fixing belt 21. The base layer 21*a* is made of a metal material such as nickel or stainless steel (SUS) or a resin material such as polyimide (PI). On the outer side thereof, the fixing belt 21 includes a release layer 21*c* made of tetrafluoroethylene-perfluoroalkylvinylether copolymer (PFA) or polytetrafluoroethylene (PTFE). In addition, an elastic layer 21*b* made of silicone rubber, foamed silicone rubber, or fluoro-rubber is disposed between the base layer 21*a* and the release layer 21*c*.

The pressure roller 22 includes a core bar 22*a*, an elastic layer 22*b* disposed on the surface of the core bar 22*a*, and a release layer 22*c* disposed on the elastic layer 22*b*. The elastic layer 22*b* is made of or includes foamed silicone rubber, silicone rubber, or the fluoro-rubber. The release layer 22*c* is made of or includes PFA or PTFE. The fixing device 20 further includes the pressing member to press the pressure roller 22 toward the fixing belt 21, and the pressure roller 22 is pressed against the nip forming pad 24 via the fixing belt 21.

For example, the pressing member is a spring to exert resilience, a sponge to exert elasticity, or a solenoid to exert electromagnetic force.

The elastic layer 22*b* of the pressure roller 22 is squeezed at a portion where the pressure roller 22 is pressed against the fixing belt 21, thereby forming a nip N (i.e., a fixing nip) having a predetermined width, in which an unfixed image (or unfixed toner T in FIG. 2) is fixed on the recording sheet P transported in the direction indicated by arrow A in FIG.

2. The pressure roller 22 is rotated by a driving source such as a motor of the body of the image forming apparatus 1. As the pressure roller 22 is driven, the driving force is transmitted from the pressure roller 22 to the fixing belt 21 in the nip N, thereby rotating the fixing belt 21.

In the present embodiment, the pressure roller 22 is a hollow roller. In another embodiment, the pressure roller 22 is a solid roller. In an embodiment in which the pressure roller 22 is a hollow roller, a heat source such as a halogen heater can be disposed inside the pressure roller 22. If the pressure roller 22 does not include an elastic layer, the thermal capacity of the pressure roller 22 is small and the fixing capability is improved. When the unfixed toner is pressed and fixed, however, minute projections and recesses of the belt surface are transferred to the unfixed toner, making the gloss of a solid image portion uneven. To prevent such uneven gloss, the pressure roller 22 preferably includes the elastic layer 22*b*, and the thickness of the elastic layer 22*b* is preferably 100 μm or greater. Since the elastic deformation of the elastic layer with a thickness of 100 μm or greater can absorb the minute projections and recesses of the belt surface, uneven gloss can be inhibited. The elastic layer 22*b* can be formed of solid rubber. Alternatively, sponge rubber can be used when a heater is not disposed inside the pressure roller 22. Since the sponge rubber has a high thermal insulating capability, heat of the fixing belt 21 is less easily lost. Thus, the sponge rubber is preferable for heat insulation. In another embodiment, the fixing rotator and the opposing rotator are not pressed to each other but are disposed in contact with each other.

Both ends of the halogen heater 23 are secured to a side plate of the fixing device 20. The halogen heater 23 generates heat, given power from a power supply unit of the apparatus body, and heat output from the halogen heater 23 is controlled based on the surface temperature of the fixing belt 21 detected by the contactless temperature sensor 27. The output from the halogen heater 23 is controlled to set the temperature of the fixing belt 21 (i.e., fixing temperature) at a desired temperature. In another embodiment, an induction heating (IH) heater, a resistance heat generator (heating resistor), a carbon heater, or the like is used as a heater to heat the fixing belt 21 instead of the halogen heater.

The nip forming pad 24 extends long in the axial direction of the fixing belt 21 or the axial direction of the pressure roller 22 and is secured and supported by the stay 25. This structure inhibits flexure of the nip forming pad 24 due to the pressure from the pressure roller 22 so that the nip width is uniform throughout in the axial direction of the pressure roller 22. When the stay 25 is made of a metal material, such as stainless steel or iron, having a high mechanical strength, the capability to inhibit flexure of the nip forming pad 24 is high. However, the stay 25 can be made of resin.

Further, the nip forming pad 24 is made of a heat-resistant material capable of withstanding 200° C. or high. This structure inhibits thermal deformation of the nip forming pad 24 in the range of toner fusing temperature and keeps the nip N in a stable state, thereby stabilizing the quality of output images. The nip forming pad 24 can be made of a common heat-resistant resin. Examples of the heat-resistant resin include polyether sulfone (PES), polyphenylene sulfide (PPS), liquid crystal polymer (LCP), polyether nitrile (PEN), polyamide imide (PAI), and polyether ether ketone (PEEK).

The surface of the nip forming pad 24 is covered with a low-friction film 29 (i.e., a slidable sheet). While rotating, the fixing belt 21 slides on the low-friction film 29 so that the driving torque of the fixing belt 21 is reduced. Thus, the load on the fixing belt 21 due to the friction is alleviated.

The low-friction film 29 is a mesh-like sheet in which polytetrafluoroethylene (PTFE) fibers are twisted to reduce the frictional resistance with the fixing belt 21. Alternatively, the low-friction film 29 can be made of, for example, glass fibers coated with fluorine and made in a fabric shape.

The reflector 26 is disposed between the stay 25 and the halogen heater 23. The halogen heater 23 is disposed inside the loop of the fixing belt 21. In the present embodiment, the reflector 26 is secured to the stay 25. Since the reflector 26 is directly heated by the halogen heater 23, the reflector 26 is preferably made of a metal having a high melting point or the like. With the reflector 26 located as described above, the light emitted from the halogen heater 23 toward the stay 25 is reflected to the fixing belt 21. This structure increases the amount of light irradiating the fixing belt 21 and efficiently heats the fixing belt 21. Further, since the radiant heat from the halogen heater 23 is inhibited from being transmitted to the stay 25 and the like, energy can be saved.

In another embodiment, instead of providing the reflector 26, the surface of the stay 25 on the side of the halogen heater 23 is subjected to mirror finishing, such as polishing or coating, and made into a reflection face. The reflector 26 or the reflection face of the stay 25 preferably has a reflectance of 90% or higher.

When the reflector 26 is used separately from the stay 25, flexibility in selecting shape and material is widened since the shape and material of the stay 25 are restricted to attain the mechanical strength. Further, when the separate reflector 26 is used, each of the reflector 26 and the stay 25 can be tailored for a specialized function. In addition, in the structure in which the reflector 26 is disposed between the halogen heater 23 and the stay 25, the reflector 26 is located near the halogen heater 23 so that the fixing belt 21 is heated efficiently.

To further enhance the efficiency in heating the fixing belt 21 with the reflection of light, orientation of the reflector 26 (or the reflection face of the stay 25) is considered. For example, when a reflection face 26*a* (facing the halogen heater 23) of the reflector 26 is disposed along a circle centered around the center of the halogen heater 23, the light is reflected back to the halogen heater 23, and the heating efficiency is reduced by the amount equivalent to the reflection. By contrast, when a portion or all of the reflection face 26*a* is oriented in a direction to reflect the light toward the fixing belt 21 other than a direction to the halogen heater 23, the amount of light reflected back to the halogen heater 23 decreases. Such a structure enhances the efficiency in heating with the reflection of light.

The fixing device 20 according to the present embodiment includes various structural ingenuity to further improve energy saving and reduce first print-out time.

For example, the halogen heater 23 directly heats a portion of the fixing belt 21 other than the nip N in the arc-like direction in which the fixing belt 21 is looped or rotates. Thus, the fixing device 20 employs direct heating. In the present embodiment, as illustrated in FIG. 2, there is no obstacle between the fixing belt 21 and the halogen heater 23 on the left side inside the fixing belt 21 so that the radiant heat from the halogen heater 23 is directly given to the fixing belt 21.

Further, the fixing belt 21 is thin and has a small diameter to reduce the thermal capacity thereof. Specifically, the base layer 21*a* is from 20 to 50 μm in thickness, the elastic layer 21*b* is from 100 to 300 μm in thickness, and the release layer 21*c* is 10 to 50 μm in thickness. The fixing belt 21 is 1 mm or thinner in total thickness. The diameter of the fixing belt 21 is set in a range of from 20 to 40 mm. To reduce the thermal capacity, the total thickness of the fixing belt 21 is preferably smaller than 0.2 mm, and more preferably smaller than 0.16 mm. The diameter of the fixing belt 21 is preferably smaller than 30 mm.

In the present embodiment, the diameter of the pressure roller 22 is set to 20 to 40 mm. The fixing belt 21 is equivalent in diameter to the pressure roller 22, but the diameters thereof are not necessarily equivalent. For example, the diameter of the fixing belt 21 can be smaller than that of the pressure roller 22. In such a case, since the curvature radius of the fixing belt 21 in the nip N is smaller than that of the pressure roller 22, the recording sheet P discharged from the nip N is easily separated from the fixing belt 21.

(Safety Device)

Next, descriptions are given below of a safety device 40 of the fixing device 20 according to the present embodiment.

A structure of the safety device 40 is described below.

As illustrated in FIG. 8, the safety device 40 according to the present embodiment includes the controller 51 (i.e., the apparatus controller) and the contactless temperature sensor 27. The contactless temperature sensor 27 detects the temperature of the outer face of the fixing belt 21. The safety device 40 is configured to stop, via the heater controller 42, heating by the halogen heater 23 when the temperature detected by the contactless temperature sensor 27 is higher than or equal to a predetermined temperature. For example, the predetermined temperature mentioned here is a highest tolerable temperature of the fixing belt 21. Alternatively, the predetermined temperature is set to a temperature lower than the highest tolerable temperature with a margin kept.

The contactless temperature sensor 27 contactlessly detects the temperature of the outer face of the fixing belt 21. The contactless temperature sensor 27 is a known infrared temperature sensor such as a thermopile or a thermopile array. Infrared temperature sensors are configured to receive, at a position away from the fixing belt 21, infrared rays radiated from the outer face of the fixing belt 21 and detect the temperature based on a bundle of radiated rays. For example, when a thermopile, which is one type of contactless infrared temperature sensors, contactlessly receives infrared rays radiated from an object, an infrared sensor generates a thermal electromotive force corresponding to the amount of energy received, and the thermopile measures the thermal electromotive force, thereby detecting the temperature. In another embodiment, instead of the thermopile, a photo diode is used to detect infrared rays. The contactless temperature sensor 27 transmits temperature data, representing the detected temperature of the fixing belt 21, to the controller 51.

The controller 51 executes, in addition to the programs to control the operations of each part involved in image formation, a temperature control program stored in the ROM 53. Specifically, the controller 51 receives the temperature data on the fixing belt 21, generated by the contactless temperature sensor 27. The controller 51 determines whether the detected temperature represented by the temperature date is equal to or higher than the predetermined temperature. When the detected temperature is higher than or equal to the predetermined temperature, the controller 51 transmits a control signal to the heater controller 42 to stop the heating by the halogen heater 23. It is to be noted that, the location of the controller 51 is not limited to the apparatus body.

Next, location of the contactless temperature sensor 27 is described.

The contactless temperature sensor 27 is disposed at a predetermined distance from the outer face of the fixing belt 21 in the radial direction of the fixing belt 21. To detect the temperature of a most heated portion of the fixing belt 21, as illustrated in FIG. 2, the contactless temperature sensor 27 is disposed opposing a range of the fixing belt 21 closest to the halogen heater 23. A light-receiving face of the contactless temperature sensor 27 is disposed facing the outer face of the fixing belt 21 so that the amount of light received becomes greatest. In the axial direction of the looped fixing belt 21, the contactless temperature sensor 27 faces a center area of the fixing belt 21. Alternatively, when sheet feeding employs edge alignment, in which a recording sheet is pulled to one side in the sheet width direction (perpendicular to the sheet conveyance direction), the contactless temperature sensor 27 is disposed corresponding to the center of the sheet in the sheet width direction. Alternatively, in configurations in which the outer face of the fixing belt 21 falls within a viewing angle θ (to be described later) of the fixing belt 21, the contactless temperature sensor 27 can be disposed facing an end (or a given position) of the fixing belt 21 in the axial direction of the fixing belt 21. In the present embodiment, although one contactless temperature sensor 27 is used, a plurality of contactless temperature sensors can be used.

Figure 3:
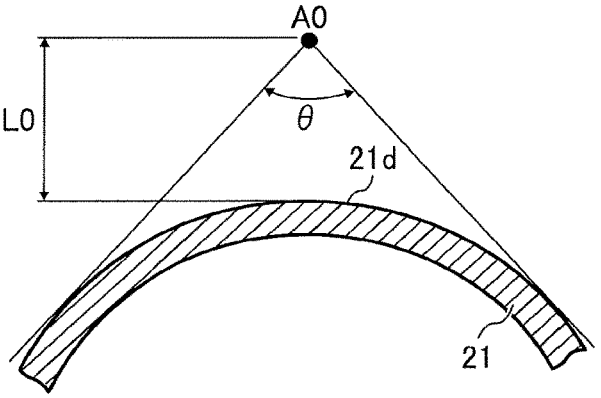
FIG. 3 is a diagram illustrating an example location of a contactless temperature sensor.

The contactless temperature sensor 27 has the viewing angle θ, which is an angle range in which the contactless temperature sensor 27 can receive infrared rays from the object to be detected (i.e., a detected object), referring to FIG. 3, in which the contactless temperature sensor 27 is disposed at a position A0. If an object different from the detected object enters the viewing angle θ, the contactless temperature sensor 27 undesirably detects the infrared rays emitted from the object not to be detected. Then, the accuracy of temperature detection is degraded. Accordingly, to attain a high degree of accuracy in temperature detection, the contactless temperature sensor 27 is preferably disposed such that only the fixing belt 21 is included in the viewing angle θ. Therefore, in a case where the viewing angle θ is wide (e.g., the viewing angle θ is 90 degrees), the contactless temperature sensor 27 is disposed closer to the fixing belt 21 compared with a case where the viewing angle θ is narrow (e.g., the viewing angle θ is 5 degrees). However, if the contactless temperature sensor 27 is extremely close to the fixing belt 21, there is a risk that the contactless temperature sensor 27 contacts the fixing belt 21. Due to the contact therebetween, the fixing belt 21 may be damaged or toner adheres to the contactless temperature sensor 27, degrading the accuracy of temperature detection.

FIG. 3 is a partial cross-sectional view that schematically illustrates relative positions of an outer face 21*d* of the fixing belt 21 and the contactless temperature sensor 27. In FIG. 3, the contactless temperature sensor 27 having the viewing angle θ is disposed at the position A0, which is at a distance L0 from the outer face 21*d* of the fixing belt 21. FIG. 3 illustrates an example placement in which the outer face 21*d* of the fixing belt 21 fits in the viewing angle θ of the contactless temperature sensor 27. When the distance between the outer face 21*d* of the fixing belt 21 and the contactless temperature sensor 27 is not longer than the distance L0, the viewing angle θ is filled with the outer face 21*d* of the fixing belt 21, and the contactless temperature sensor 27 does not receive infrared rays from any object not to be detected. Thus, the accuracy of temperature detection is good. The position of the contactless temperature sensor 27, however, is close to the fixing belt 21, and the risk of the above-described inconveniences increases. By contrast, when the distance between the outer face 21*d* of the fixing belt 21 and the contactless temperature sensor 27 is longer than the distance L0, other objects than the outer face 21*d* of the fixing belt 21 can fall in the viewing angle θ. In this case, although the accuracy of temperature detection is degraded, the above-mentioned inconveniences, caused by the contactless temperature sensor 27 being close to the fixing belt 21, do not occur.

Figure 4:
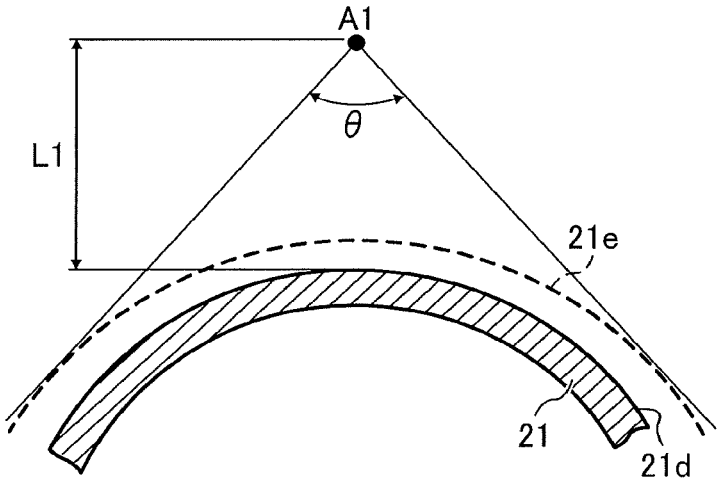
FIG. 4 is a diagram illustrating a location of the contactless temperature sensor according to an embodiment.

Referring to FIG. 4, as the fixing belt 21 is heated, the fixing belt 21 thermally expands to the outer side in the radial direction of the looped fixing belt 21. In the present embodiment, as illustrated in FIG. 4, the contactless temperature sensor 27 is disposed at such a position (e.g., a position A1) that the proportion of the outer face 21*d* of the fixing belt 21 in the viewing angle θ increases as the fixing belt 21 thermally expands.

FIG. 4 is a partial cross-sectional view that schematically illustrates relative positions of an outer face 21*e* (indicated by broken lines) of the expanded fixing belt 21 and the contactless temperature sensor 27. The contactless temperature sensor 27 having the viewing angle θ is disposed at the position A1, which is at a distance L1 from the outer face 21*d* (not expanded) of the fixing belt 21. The broken lines in FIG. 4 represent the outer face 21*e* of the expanded fixing belt 21 that has been heated to the predetermined temperature (e.g., the highest tolerable temperature). FIG. 4 illustrates such a placement that, when the outer face of the fixing belt 21 is at the predetermined temperature (the fixing belt 21 has expanded), the outer face 21*e* of the fixing belt 21 fits in the viewing angle θ of the contactless temperature sensor 27. Accordingly, in the placement in which the contactless temperature sensor 27 is disposed at the position A1, the proportion of the outer face 21*e* in the viewing angle θ increases until the temperature of the fixing belt 21 reaches the highest tolerable temperature. With this structure, the safety device 40 can detect that the temperature of the fixing belt 21 has reached the highest tolerable temperature reliably and promptly.

Figure 5:
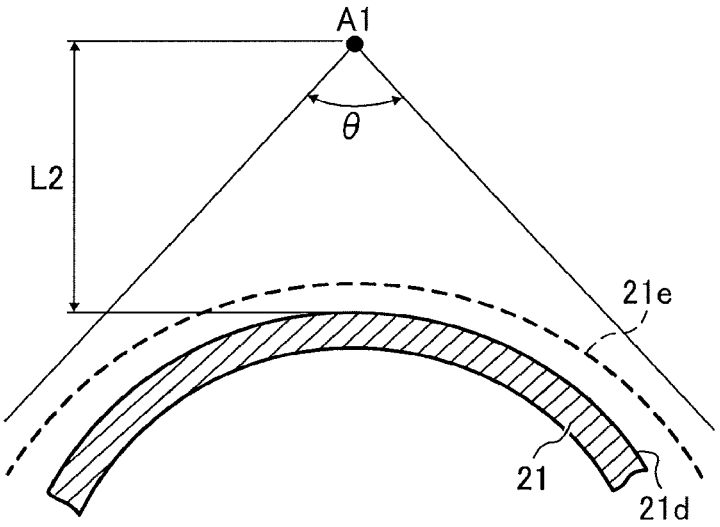
FIG. 5 is a diagram illustrating another example location of the contactless temperature sensor.

As long as the contactless temperature sensor 27 is at a distance farther than the distance L0 illustrated in FIG. 3 from the outer face 21*d* of the fixing belt 21 that is not expanded, the proportion of the outer face 21*d* of the fixing belt 21 increases as the fixing belt 21 thermally expands. In FIG. 5, the contactless temperature sensor 27 is at a position A2, which is at a distance L2 from the outer face 21*d* of the unexpanded fixing belt 21. The distance L2 is longer than the distance L1 illustrated in FIG. 4. In FIG. 5, the contactless temperature sensor 27 can receive infrared rays emitted from other objects than the outer face 21*e* of the expanded fixing belt 21 when the temperature of the fixing belt 21 has reached the highest tolerable temperature. Then, the accuracy of temperature detection is degraded. Accordingly, it is preferred that a distance L between the contactless temperature sensor 27 and the unexpanded outer face 21*d* of the fixing belt 21 is greater than the distance L0 and not greater than the distance L1 ($L0<L\leq L1$). More preferably, the distance L between the contactless temperature sensor 27 and the unexpanded outer face 21*d* of the fixing belt 21 is set at the distance L1 (illustrated in FIG. 4).

With this placement, even in the configuration in which the viewing angle θ of the contactless temperature sensor 27 is relatively wide, the contactless temperature sensor 27 can be disposed at a desirable position from, not too close to, the fixing belt 21, and overheat of the fixing belt 21 can be reliably detected.

Next, descriptions are given below of thermal expansion of the fixing belt 21.

FIG. 6 is a partial cross-sectional view that schematically illustrates relative positions of the fixing belt 21 and the contactless temperature sensor 27 being disposed at the position A1 (see FIG. 4). The fixing belt 21 is multilayered and includes a plurality of layers, namely, the base layer 21*a*, the elastic layer 21*b*, and the release layer 21*c* in this order from the inner side in the radial direction of the looped fixing belt 21. The fixing belt 21 is configured to thermally expand such that the outer face 21*d* shifts outward in the radial direction, being heated by the halogen heater 23. In FIG. 4, broken lines represent the outer face 21*e* of the expanded fixing belt 21 when the surface temperature of the fixing belt 21 has reached the predetermined temperature (e.g., the highest tolerable temperature).

Figure 7:
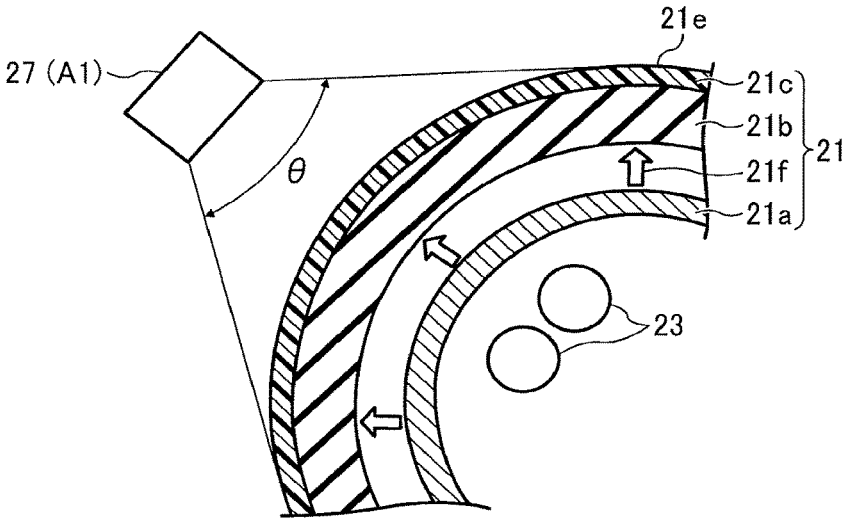
FIG. 7 is a cross-sectional view illustrating a state in which multiple layers of the fixing belt are delaminated and the fixing belt is thermally expanded.

Specifically, as illustrated in FIG. 7, in the plurality of layers (21*a*, 21*b*, and 21*c*) of the fixing belt 21, the outer one (the elastic layer 21*b*) of at least two layers (e.g., the base layer 21*a* and the elastic layer 21*b*) adjacent to each other in the thickness direction (radial direction of the looped fixing belt 21) is higher in coefficient of thermal expansion than the inner one (the base layer 21*a*) of the two layers. Further, the fixing belt 21 is configured so that delamination occurs therein when the temperature of the fixing belt 21 reaches or exceeds the predetermined temperature. Accordingly, the fixing belt 21 expands such that the outermost layer (e.g., the release layer 21*c*) of the fixing belt 21, is shifted outward in the radial direction. For example, the predetermined temperature mentioned here is the highest tolerable temperature of the fixing belt 21. Alternatively, the predetermined temperature is set to a temperature lower than the highest tolerable temperature with a margin kept.

The adjacent two layers are not limited to the base layer 21*a* and the elastic layer 21*b* but can be elastic layer 21*b* and the release layer 21*c*. Further, the two layers are not necessarily directly adjacent to each other, and an adhesive layer or the like can be interposed therebetween.

Alternatively, in the plurality of layers (21*a*, 21*b*, and 21*c*) of the fixing belt 21, the inner one (the elastic layer 21*b*) of at least two layers (e.g., the elastic layer 21*b* and the release layer 21*c*) adjacent to each other in the thickness direction (radial direction of the looped fixing belt 21) is higher in coefficient of thermal expansion than the outer one (the release layer 21*c*) of the two adjacent layers. In other words, the outer layer is lower in coefficient of thermal expansion than the inner layer.

In this case, the outer layer (the release layer 21*c*) is configured to have elasticity so that the outer layer expands in conformity to the expansion of the inner layer (the elastic layer 21*b*). Alternatively, when the outer layer (the release layer 21*c*) is not elastic, the inner layer (the elastic layer 21*b*) can break the outer layer to be exposed. Then, the face of the inner layer becomes the outer face of the fixing belt 21, and the outer face of the fixing belt 21 is shifted outward in the radial direction.

In the case where the fixing belt 21 includes a material having a high coefficient of thermal expansion as described above, there is a risk of delamination in a temperature range of normal operation. In this case, as illustrated in FIG. 7, the fixing belt 21 can further include an interlayer 21*f* interposed (i.e., an adhesive layer) between the two layers (e.g., the base layer 21*a* and the elastic layer 21*b*) in which delamination occurs when the surface temperature of the fixing belt 21 reaches the predetermined temperature. The interlayer 21*f* is made of an adhesive material that loses adhesiveness at a temperature equal to or higher than the predetermined temperature. When the interlayer 21*f* made of the adhesive material, such as thermoplastic resin, is disposed between the two layers having the possibility of delamination, the two layers are inhibited from peeling off from each other before the temperature of the fixing belt 21 reaches the predetermined temperature (e.g., the highest tolerable temperature). When the fixing belt 21 is overheated and has a temperature higher than the tolerable temperature for the adhesive material, the adhesive material loses adhesiveness and no longer serves as the adhesive layer. Using such an adhesive material, the bonded layers are configured to peel off from each other only when the fixing belt 21 is overheated. Although the temperature at which the adhesive material loses adhesiveness (i.e., adhesiveness-lost temperature) is the highest tolerable temperature of the fixing belt 21 in the description above, alternatively, the adhesiveness-lost temperature can be lower than the highest tolerable temperature with a margin kept.

In another embodiment, the fixing belt 21 includes, instead of the adhesive material, the interlayer 21*f* is made of a sublimation material that sublimates from a solid state into a gas at a temperature equal to or higher than a given temperature (i.e., a sublimation temperature). Thus, the interlayer 21*f* serves as a sublimation layer. The sublimation layer can attain the effect similar to the effect attained by the interlayer 21*f* made of the adhesive material. The sublimation temperature is either the highest tolerable temperature of the fixing belt 21 or a temperature lower than the highest tolerable temperature with a margin kept. In yet another embodiment, the fixing belt 21 includes both of the adhesive layer and the sublimation layer. Alternatively, the fixing belt 21 includes a layer made of a mixture of the adhesive material and the sublimation material.

As described above, in the fixing device 20 and the image forming apparatus 1 according to one aspect of the present disclosure, the contactless temperature sensor 27 of the safety device 40 is disposed such that the proportion of the fixing belt 21 (the outer face 21*d* in particular) in the viewing angle θ of the contactless temperature sensor 27 increases as the fixing belt 21 thermally expands outward in the radial direction of the fixing belt 21, due to the temperature rise of the fixing belt 21.

With this arrangement, in the fixing device 20 and the image forming apparatus 1 according to one aspect of the present disclosure, although the viewing angle θ of the contactless temperature sensor 27 is relatively wide, the contactless temperature sensor 27 can be disposed at a desirable distance away from the fixing belt 21. Accordingly, risk of damage to the fixing belt 21 caused by sliding contact with the contactless temperature sensor 27 is reduced. Additionally, overheat of the fixing belt 21 can be detected reliably, owing to the increase of the proportion of the fixing belt 21 in the viewing angle θ.

According to another aspect of the preset disclosure, the outer one (e.g., the elastic layer 21*b*) of a plurality of layers of the fixing belt 21 is higher in coefficient of thermal expansion than the inner one (e.g., the base layer 21*a*) of the plurality of layers, and delamination occurs between the two layers at a temperature equal to or higher than the predetermined temperature, so that the fixing belt 21 expands with the outer face thereof bulges outward in the radial direction of the fixing belt 21.

With this structure, the delamination in the fixing belt 21 promotes the expansion of the fixing belt 21 so that the contactless temperature sensor 27 can detect the overheating at an earlier timing.

According to another aspect of the preset disclosure, the inner one (e.g., the elastic layer 21*b*) of a plurality of layers of the fixing belt 21 is higher in coefficient of thermal expansion than the outer one (e.g., the release layer 21*c*) of the plurality of layers.

With such properties of the fixing belt 21, even in a configuration in which the outermost layer (e.g., the release layer 21*c*) constituting the outer face of the fixing belt 21 is lower in coefficient of thermal expansion than the inner layer, the elastic outermost layer can expand in conformity to the expansion of the inner layer having a higher coefficient of thermal expansion. Then, the outer face 21*d* of the fixing belt 21 can bulge. Alternatively, in the configuration in which the outermost layer (e.g., the release layer 21*c*) constituting the outer face of the fixing belt 21 is not elastic, the inner layer (e.g., the elastic layer 21*b*) is allowed to break the outer layer and be exposed. As a result, the outer face 21*d* of the fixing belt 21 can bulge. Accordingly, the contactless temperature sensor 27 can detect the overheating of the fixing belt 21 at an earlier timing.

According to another aspect of the present disclosure, the interlayer 21*f* is interposed between the two layers (e.g., the base layer 21*a* and the elastic layer 21*b*) in which delamination is to occur, and the interlayer 21*f* is made of an adhesive material that loses adhesiveness at a temperature equal to or higher than the predetermined temperature.

With this structure, delamination is inhibited in the temperature range of normal operation of the fixing device 20, and delamination reliably occurs when the temperature reaches or exceeds the predetermined temperature.

According to another aspect of the present disclosure, an interlayer made of a sublimation material is interposed between the two layers (e.g., the base layer 21*a* and the elastic layer 21*b*) in which delamination is to occur, and the sublimation material sublimates from a solid state into gas at a temperature equal to or higher than the predetermined temperature.

With this structure, delamination does not occur below the predetermined temperature, and delamination reliably occurs when the temperature reaches or exceeds the predetermined temperature.

As described above, one aspect of the present disclosure attains effects that, even in a safety device employing a contactless temperature sensor having a relatively large viewing angle, damage to the fixing belt caused by sliding contact with the temperature sensor is inhibited, and overheat of the fixing belt is reliably detected. One or more aspects of the present disclosure are applicable to fixing devices used in electrophotographic image forming apparatuses, such as copiers, printers, and facsimile machines and further to image forming apparatuses incorporating the fixing device.

It is to be noted that, in another embodiment, not the apparatus body but the fixing device 20 includes the controller 51. In yet another embodiment, the controller 51 may be disposed in a remote computer electrically connected to the image forming apparatus 1. Thus, such a configuration is expressed as the following aspect.

A fixing device includes a fixing belt having an endless shape and including at least two layers adjacent in a radial direction of the fixing belt. The fixing belt is configured to rotate and thermally expand. The fixing device further includes an opposing rotator disposed opposite the fixing belt and pressed to the fixing belt to form a nip, a heater disposed inside the fixing belt to heat the fixing belt, and a contactless temperature sensor disposed outside the fixing belt and apart from an outer face of the fixing belt. The contactless temperature sensor is configured to detect a temperature of the fixing belt and transmit a detection result to a controller (of either an image forming apparatus or a remote computer electrically connected to the image forming apparatus) configured to control the heater based on a detection result generated by the contactless temperature. The contactless temperature sensor is disposed such that a proportion of the outer face of the fixing belt in a viewing angle of the contactless temperature sensor increases as the outer face of the fixing belt shifts outward in the radial direction due to thermal expansion of the fixing belt.

In yet another aspect, the fixing device further includes a heater controller electrically connected to the controller (of either an image forming apparatus or a remote computer).

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

For example, the image forming apparatus to which at least one of the aspects of this disclosure are applied is not limited to the image forming apparatus illustrated in FIG. 1 but include other types of image forming apparatuses, such as monochrome image forming apparatuses, multicolor laser printers, other types of printers, copiers, facsimile machines, and multifunction peripherals having a plurality of capabilities.

What is claimed is:

1. A fixing device comprising:

a fixing belt having an endless shape and including at least two layers adjacent in a radial direction of the fixing belt, the fixing belt to rotate and thermally expand;

an opposing rotator disposed opposite the fixing belt and pressed to the fixing belt to form a nip;

a heater disposed inside the fixing belt, the heater to heat the fixing belt; and a safety device including a contactless temperature sensor disposed outside the fixing belt and apart from an outer face of the fixing belt, the contactless temperature sensor to detect a temperature of the fixing belt, the safety device to stop heating by the heater when the temperature detected by the contactless temperature sensor is equal to or higher than a predetermined temperature, wherein the contactless temperature sensor is disposed such that a proportion of the outer face of the fixing belt in a viewing angle of the contactless temperature sensor increases as the outer face of the fixing belt expands outwardly in the radial direction due to thermal expansion of the fixing belt, wherein a distance (L) between the contactless temperature sensor and an unexpanded outer face of the fixing belt is in a range greater than a distance L0 and not greater than a distance L1 ($L0<L\leq L1$), where the distance L0 is a distance with which the outer face of the fixing belt fits in a viewing angle of the contactless temperature sensor before the fixing belt expands, and where the distance L1 is a distance with which the outer face of the fixing belt fits in the viewing angle θ of the contactless temperature sensor after the fixing belt expands.

2. The fixing device according to claim 1, wherein, when the temperature detected by the contactless temperature sensor is lower than the predetermined temperature, the viewing angle of the contactless temperature sensor is not filled with the fixing belt, and wherein, when the temperature detected by the contactless temperature sensor is at the predetermined temperature, the viewing angle of the contactless temperature sensor is filled with the fixing belt.

3. The fixing device according to claim 1, wherein the at least two layers of the fixing belt includes:

an inner layer; and an outer layer disposed in an outer side of the inner layer in the radial direction, the outer layer higher in coefficient of thermal expansion than the inner layer, wherein, when the temperature of the fixing belt is equal to or higher than the predetermined temperature, delamination occurs in the at least two layers to expand the outer face of the fixing belt outward in the radial direction.

4. The fixing device according to claim 3, wherein the at least two layers of the fixing belt further includes an adhesive layer interposed between the inner layer and the outer layer, the adhesive layer made of an adhesive material that loses adhesiveness at a temperature equal to or higher than the predetermined temperature.

5. The fixing device according to claim 3, wherein the at least two layers of the fixing belt further includes an interlayer interposed between the inner layer and the outer layer, the interlayer including a sublimation material that sublimates from a solid state into gas at a temperature equal to or higher than the predetermined temperature.

6. The fixing device according to claim 1, wherein the at least two layers of the fixing belt includes:

an inner layer; and an outer layer disposed in an outer side of the inner layer in the radial direction, the outer layer lower in coefficient of thermal expansion than the inner layer.

7. The fixing device according to claim 1, wherein the contactless temperature sensor is disposed opposite a range of the fixing belt closest to the heater.

8. An image forming apparatus comprising:

an image forming device to form an image; and the fixing device according to claim 1, to fix the image.

9. A fixing device comprising:

a fixing belt having an endless shape and including at least two layers adjacent in a radial direction of the fixing belt, the fixing belt to rotate and thermally expand;

an opposing rotator disposed opposite the fixing belt and pressed to the fixing belt to form a nip;

a heater disposed inside the fixing belt, the heater to heat the fixing belt; and a contactless temperature sensor disposed outside the fixing belt and apart from an outer face of the fixing belt, the contactless temperature sensor configured to detect a temperature of the fixing belt and transmit a detection result to a controller of an image forming apparatus, the contactless temperature sensor disposed such that a proportion of the outer face of the fixing belt in a viewing angle of the contactless temperature sensor increases as the outer face of the fixing belt expands outwardly in the radial direction due to thermal expansion of the fixing belt, wherein a distance (L) between the contactless temperature sensor and an unexpanded outer face of the fixing belt is in a range greater than a distance L0 and not greater than a distance L1 ($L0<L\leq L1$), where the distance L0 is a distance with which the outer face of the fixing belt fits in a viewing angle of the contactless temperature sensor before the fixing belt expands, and where the distance L1 is a distance with which the outer face of the fixing belt fits in the viewing angle θ of the contactless temperature sensor after the fixing belt expands.

* * * * *